United States Patent [19]

Arama et al.

[11] 4,259,894

[45] Apr. 7, 1981

[54] HYDROSTATIC MOTOR

[75] Inventors: Stefănică Arama; Stefan Daschievici; Cezar Ferat; Feodor Turcescu, all of Braila, Romania

[73] Assignee: Institul de Cercetări si Proiectari pentru Utulaje de Constructii de Drumuri (I.C.PU.C.), Brăila, Romania

[21] Appl. No.: 933,915

[22] Filed: Aug. 15, 1978

[51] Int. Cl.[3] ..... F01B 13/06

[52] U.S. Cl. ..... 91/487; 91/491

[58] Field of Search ..... 91/491, 487, 497

[56] References Cited

U.S. PATENT DOCUMENTS

| | | | |
|---|---|---|---|
| 3,369,457 | 2/1968 | Guinot | 91/491 |
| 3,618,467 | 6/1969 | Faisandier | 91/491 |

FOREIGN PATENT DOCUMENTS

| | | | |
|---|---|---|---|
| 1453538 | 3/1969 | Fed. Rep. of Germany | 91/491 |
| 1029659 | 5/1966 | United Kingdom | 91/491 |
| 432303 | 6/1975 | U.S.S.R. | 91/491 |

*Primary Examiner*—William L. Freeh

[57] ABSTRACT

There is disclosed a hydrostatic motor provided with radially arranged hydraulic cylinders provided with radial pistons composed of pairs of pistons with different diameters fitted one into the other. The motor is selectively operable in either of two operating conditions, in a first of which the large and small pistons move as a unit in a heavy duty operation, and in a second of which only the small pistons move in a low duty operation. The motor includes a rotor and a stator, duct means arranged in the stator for the supply of pressure fluid to the pistons, a change-over unit within the motor, and a fluid distributor unit housed in the stator. The motor of the invention employs virtually the same distributing circuits during its operation in both its heavy duty and its low duty modes of operation.

8 Claims, 7 Drawing Figures

HYDROSTATIC MOTOR

The present invention relates to a hydrostatic motor provided with radially arranged hydraulic cylinders, the motor being adapted for selective operation in a heavy duty mode and a low duty mode of operation. Although not limited thereto, the motor of the invention is adapted for use in heavy duty power driven vehicles.

There are known hydrostatic motors with radial pistons composed of pairs of pistons with different diameters, fitted one into the other, the motors being capable of operation in either a heavy duty or a low duty mode by moving the large piston in the heavy duty mode of operation of the motor and by moving the small piston in its low duty mode while stopping the large piston in its lower or radially inner position.

Among the disadvantages of such prior hydrostatic motors is the fact that they require a duplication of fluid distributing circuits in order to make possible their being changed from one mode of operation to the other.

It is among the objects of the present invention to obviate or at least to mitigate such disadvantage.

In accordance with the present invention there is provided a hydrostatic motor including a rotor and a stator, radially disposed angularly spaced cylinders, tubular pistons housed in the cylinders, additional pistons located within said tubular pistons, the tubular pistons constituting working cylinders for said additional pistons, duct means arranged in the stator for the supply of pressure fluid to the pistons, and a crosshead displacable by said additional pistons when the motor is operating in its lower duty operational mode and which is displacable by both the tubular pistons and the additional pistons when the motor is operating in its heavy duty operational mode. The motor also includes a change-over unit for selectively placing the motor in either of its operating modes, a fluid distributor unit housed in the stator and including a rotary distributor, and means for driving the rotary distributor in synchronism with the rotor. The change-over unit comprises a valve which in a first change-over operational mode delivers fluid via ducting to the tubular pistons for driving them, and in a second change-over operational mode interrupts pressure fluid flow to the lower surface of the tubular pistons while simultaneously establishing communication between said lower surface of the tubular piston and a drain circuit from the tubular pistons through ducting.

A preferred embodiment of the hydrostatic motor of the present invention will now be described by way of example, reference being had to the accompanying drawings, in which:

FIG. 1 is a view partially in vertical transverse section and partially in end elevation of a hydrostatic motor in accordance with the invention, the motor being shown operating in its heavy duty mode;

FIG. 1*a* is a view similar to FIG. 1 but showing the motor operating in its low duty mode;

Figure 1:
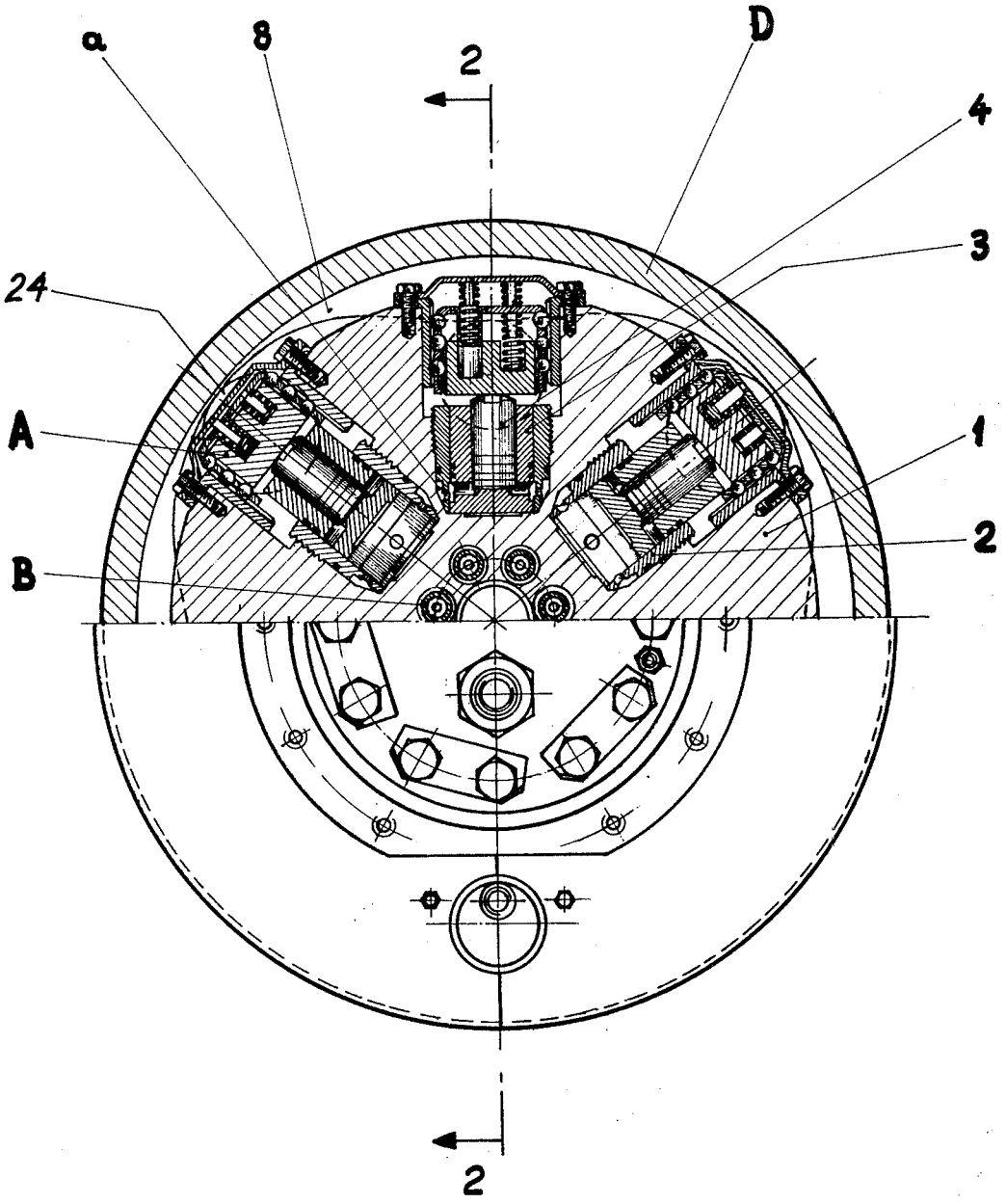
Figure 1A:
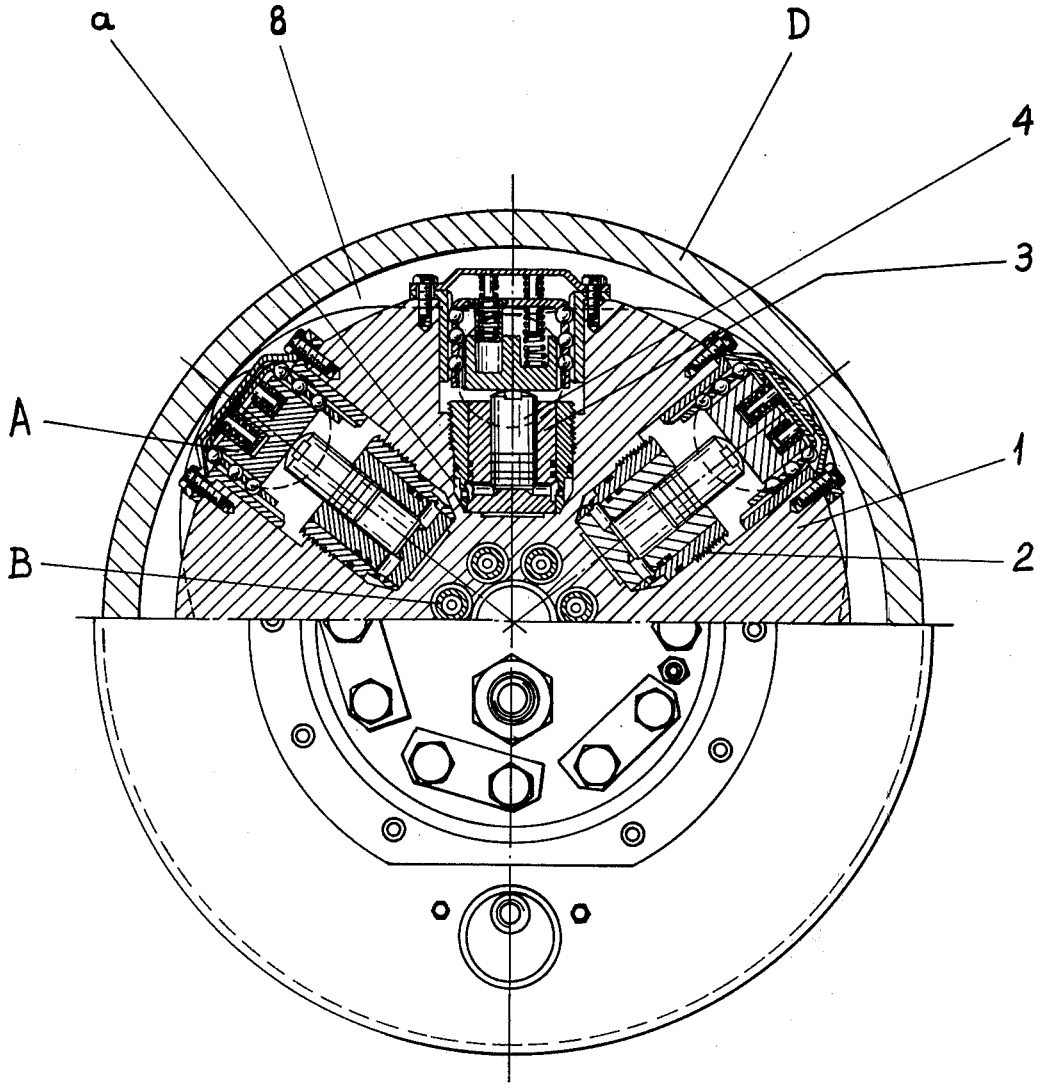

Referring to the drawings, there is there shown an inner stator 1 and an outer rotor D which surrounds the stator. Equally angularly spaced in the stator there are a plurality (seven in the motor here shown) of equally angularly spaced cylinders having removable cylinder liners 2. A first, larger piston 3 is reciprocable in each of the cylinders, the radially outer ends of each of the pistons 3 being tubular and containing coaxial thereof smaller diametered pistons 4 which are reciprocable relative to the larger pistons 3. The radially disposed seats in the stator 1 which receive the cylinder liners 2 are designated by the reference character a.

Figure 2:
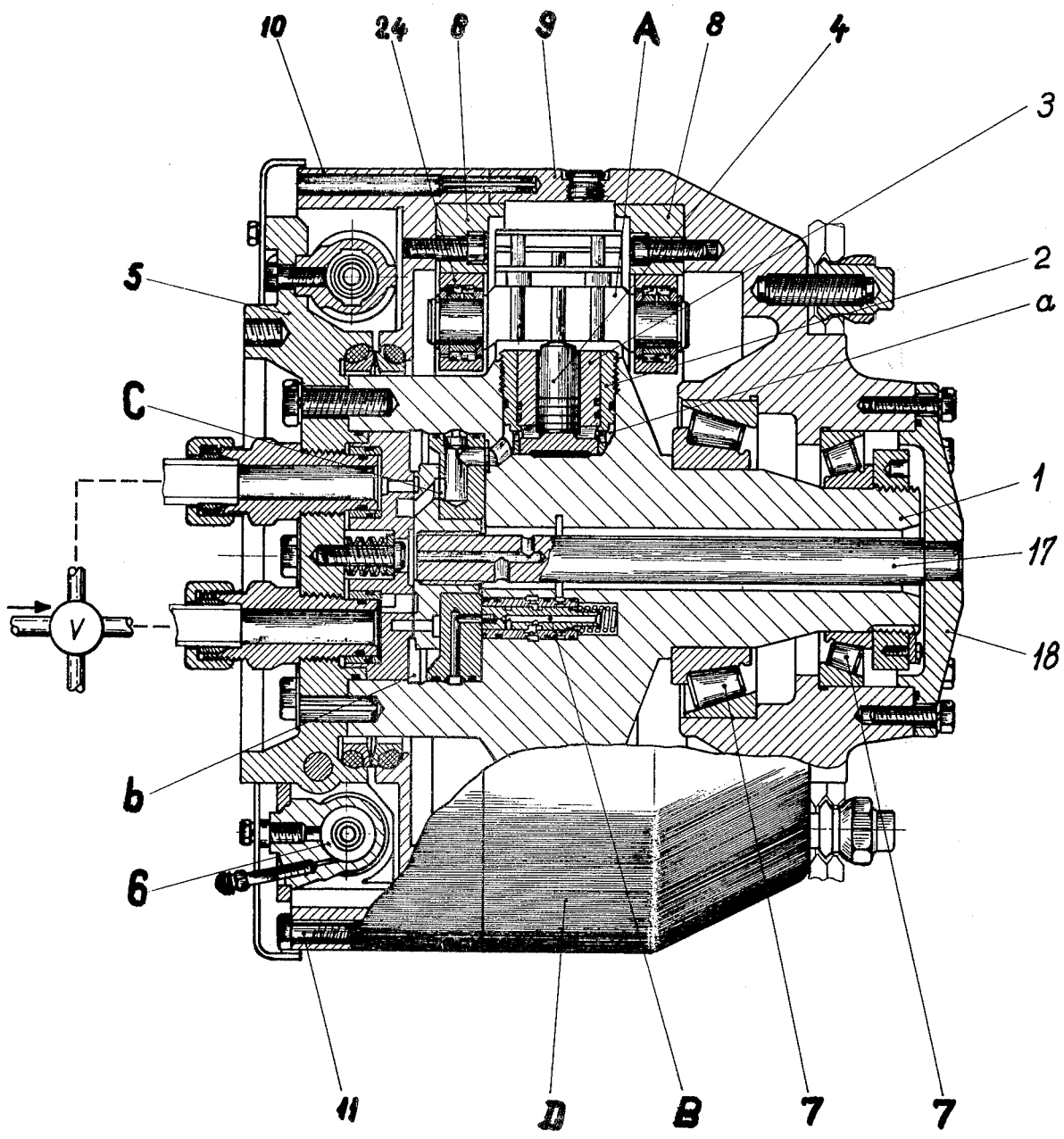
FIG. 2 is a view partially in longitudinal axial section and partially in side elevation of the motor of FIG. 1, the section being taken along the line 2—2 of FIG. 1, a valve for reversing the direction of operation of the motor being schematically shown associated with the motor.

Each of the cylinders is provided with a crosshead A at its radially outer end, the crossheads being guided for radial movement by ball bearings as shown and being thrust radially outwardly by its associated smaller piston 3 when the motor is operating in its low duty mode, and by its associated larger piston 3, acting through the respective smaller piston 4, when the motor is operating in its heavy duty mode. The rotor D is in the form of a two-part housing, the housing having a ring shaped multiple lobed cam 8 which is disposed transversely of the axis of the housing inwardly thereof to the left of the cylinders (FIG. 2), the inner lobed surface of cam 8 being engaged by rollers 24 journaled upon the respective crossheads A. Fluid under pressure is delivered to the radially inner ends of the cylinders through a selectively operated reversing valve v (FIG. 2), valve v being shiftable between two positions so that the rotor rotates in one direction when the valve is in a first position and rotates in the opposite direction when the valve is in its other operative position.

Figure 5:
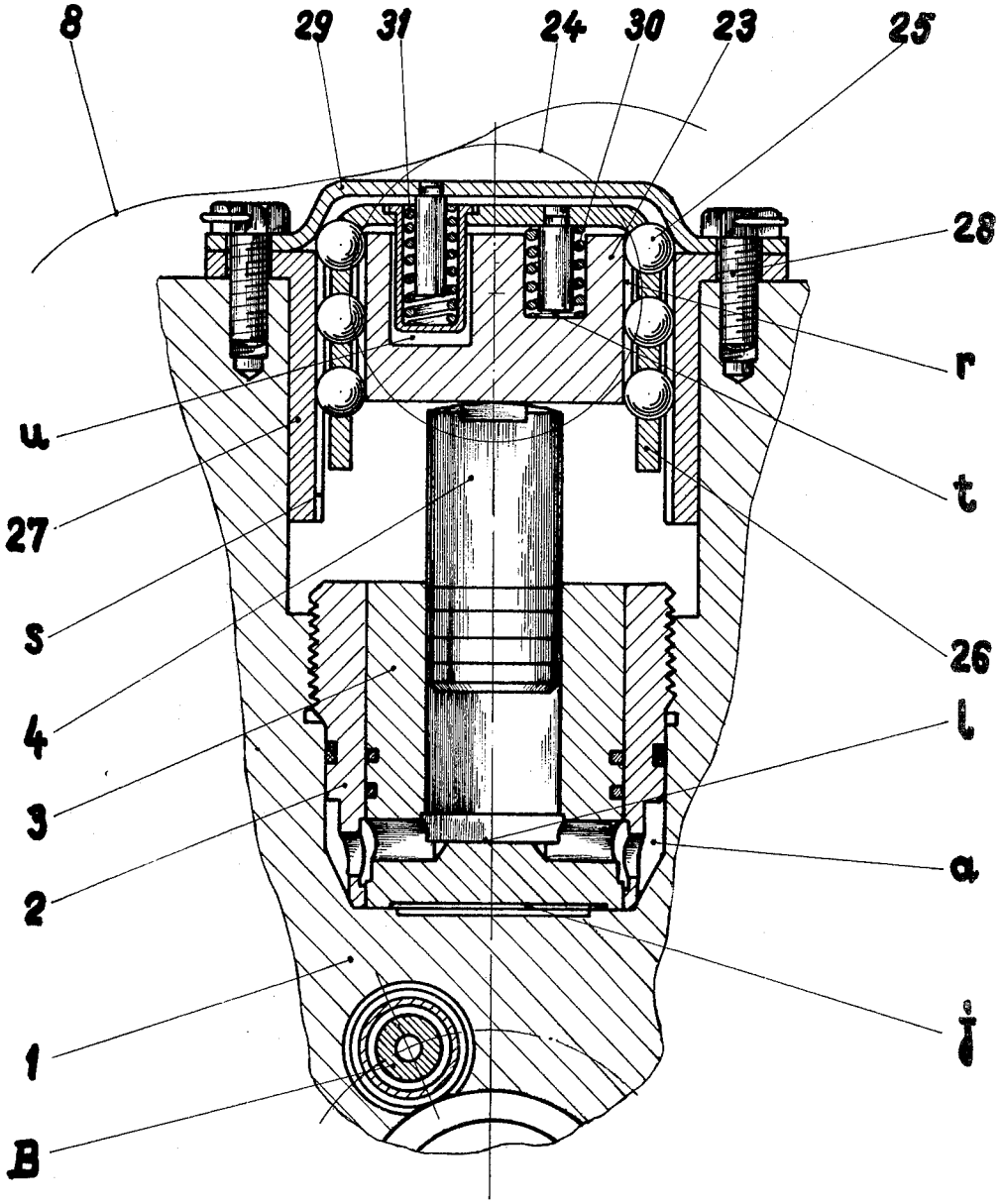
FIG. 5 is a sectional view on an enlarged scale of a crosshead and set of pistons associated with one cylinder of the motor of FIG. 1, the crosshead and set of pistons being shown at the outer end of their stroke when the motor is acting in its heavy duty mode.
Figure 5A:
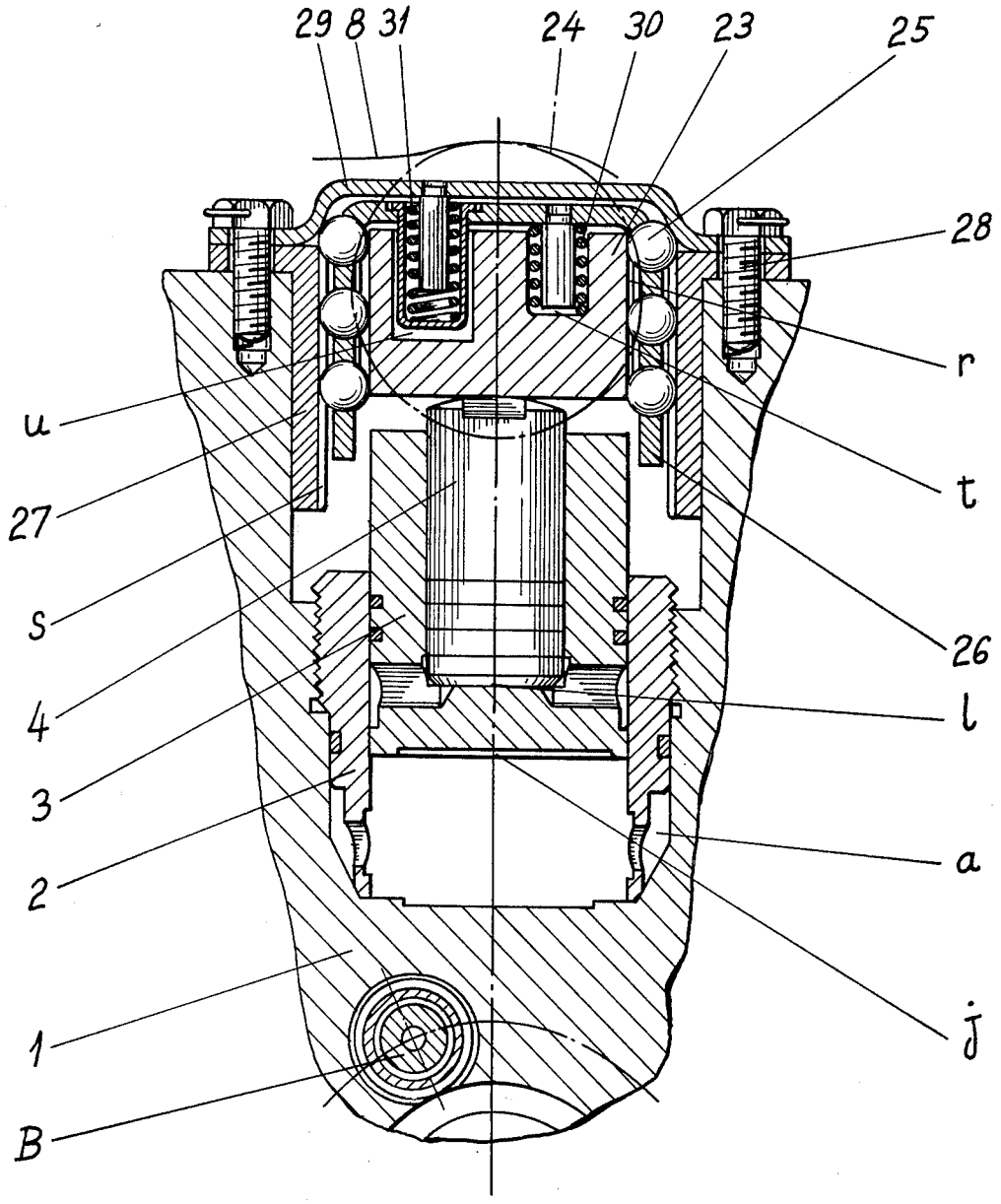
FIG. 5*a* is a view similar to FIG. 5 but with the motor operating in its low duty mode.

The crosshead A includes a prismatic body 23 on which the rollers 24 are journaled. The body 23 is provided with outwardly opening grooves r, in which balls 25 can roll, balls 25 being located by a cage 26. The balls 25 are also guided by grooves s (FIGS. 5 and 5*a*) in two slides 27 fixed in a suitable manner on stator 1, such as by means of screws 28. To obtain a correct movement of the cage from a kinematic point of view irrespective of the existence or size of forces on the crosshead A, between cage 26 and body 23, as well as between cage 26 and a cover 29, some elastic couplings are arranged by means of springs 30 and 31 mounted in seats t and u supported by the body 23. The cover 29 is fixed on stator 1 by means of the screws 28.

Each piston 4 can move a crosshead A either by means of a unit B when there is a change-over to low duty operation or when, working in a heavy duty mode, the pistons 3 are moved inside the skirts 2. A distributing unit C is mounted in a seat b located in stator 1 and is maintained in seat b by means of a cover 5 which is also the support of a brake 6.

The rotor D is mounted on stator 1 by means of radial-axial bearing 7. As above noted, the rotor D is composed of two cylindrical parts, the part to the left in FIG. 2 being designated 9 and the part to the right being designated 10. Parts 9 and 10 are assembled by means of screws 11 or in any other suitable way. Part 10 at the same time functions as a casing for the brake 6.

The unit B is composed of a control slide valve 12 mounted in a stationary bushing 13. Communicating channels c and d are arranged in stator 1 as well as channels e and f. Slide valve 12 is maintained in the position shown in FIG. 3 by a coil compression spring 14. In such position of the valve 12, the motor functions in its heavy duty mode. The valve 12 can be thrust into an upper position against the opposition of the spring 14 by subjecting the lower end of the valve 12 to fluid pressure through an external fluid pressure source through a valve v' (FIG. 3), such liquid pressure acting on the lower end face g of the slide valve 12. An axially extending bore h in valve 12 as well as radial ports i are provided in the valve 12.

Figure 3:
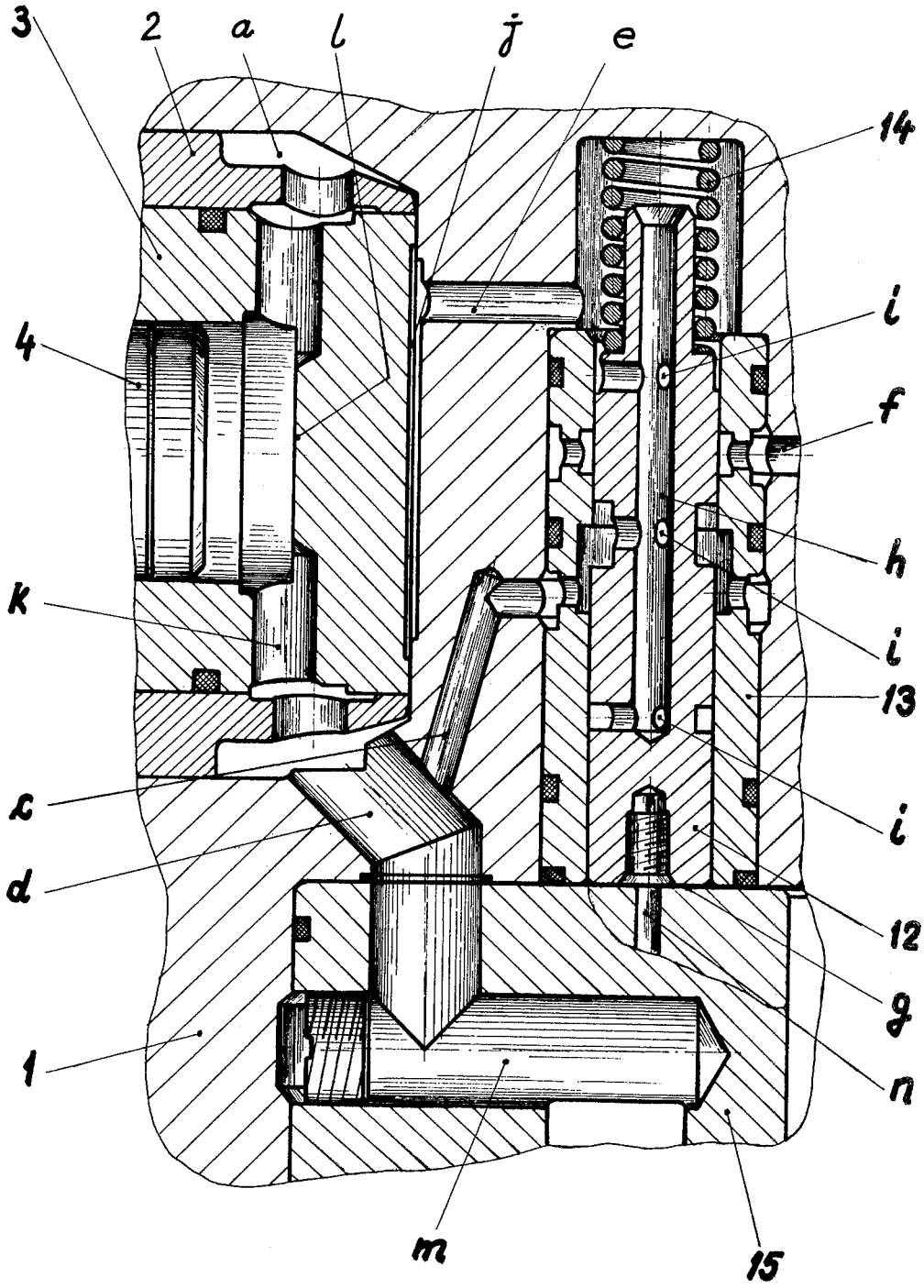
FIG. 3 is an enlarged view in vertical axial section of a control unit for the motor, the section being taken along the line 2—2 of FIG. 1, the figure showing a portion of the apparatus near its left end as shown in FIG. 2, there being schematically shown a valve which operates selectively to supply fluid from an additional source to shift the valve element of the control unit.
Figure 4:
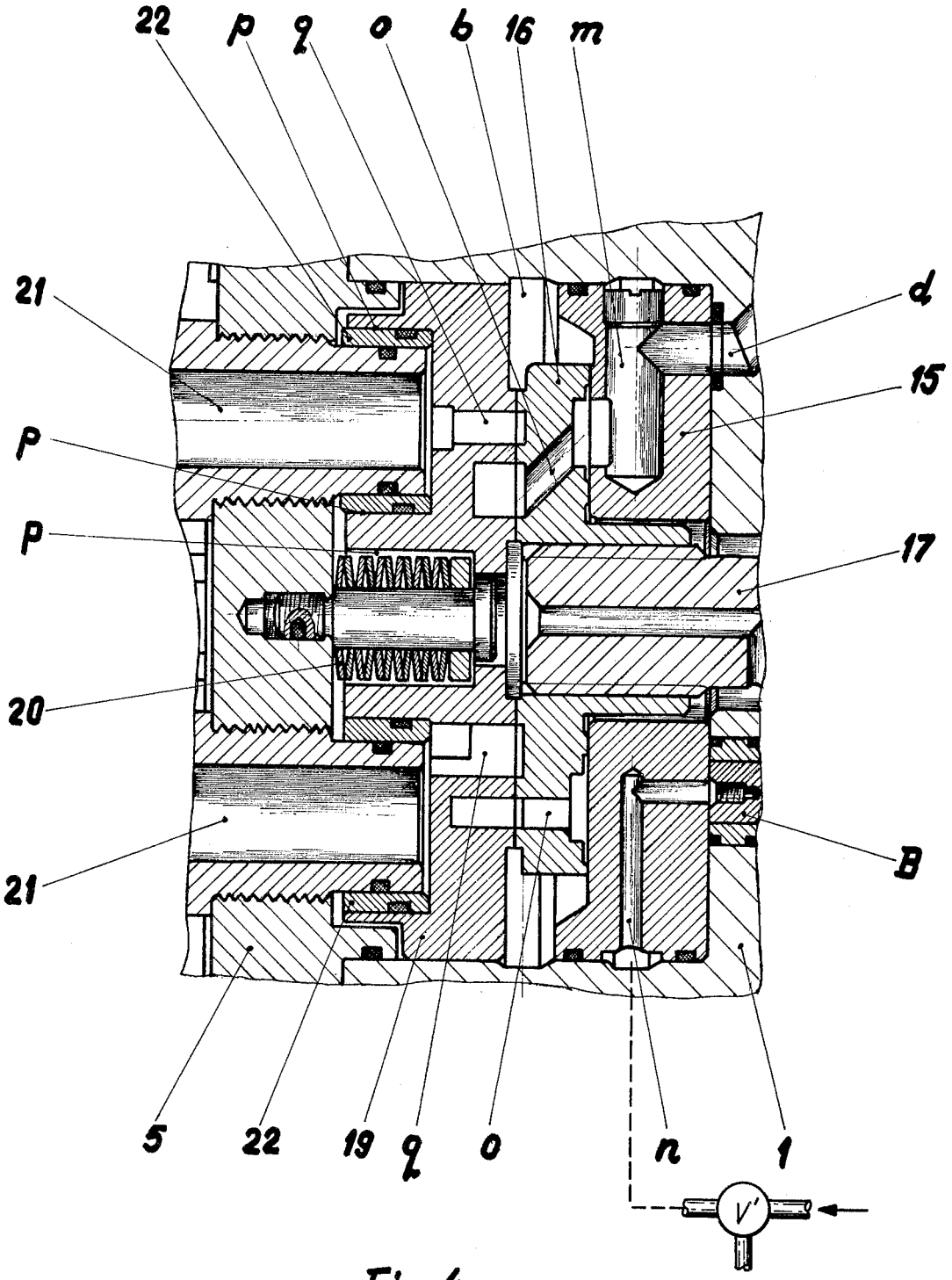
FIG. 4 is an enlarged view in section of the pressure fluid distributing unit of the motor of FIG. 1, such distributing unit being shown near the left end of FIG. 2.

As above noted, when the external control pressure delivered through valve v' is zero, the slide valve 12 is maintained by spring 14 in the position shown in FIG. 3. In this case, the pressure of the fluid delivered to the motor through the valve v (FIG. 2) acts on the lower surface j of the piston 3, such pressure fluid being delivered through the channel d. As a result of this, the piston 3 will move radially outwardly together with the piston 4, thus displacing the crosshead A. Pressure fluid to operate the piston 3 arrives at the channel d by passing through channel c, h, and e as well as ports i. Under the described conditions, the motor is operating in its heavy duty mode.

When an external fluid pressure is applied to the end face g of the slide valve 12 through valve v', the slide valve 12 is displaced upwardly (FIG. 3) thus compressing the spring 14. In this case, channel e is connected with channel f and as a result the surface j of piston 3 is connected to drain and channel c is blocked. The liquid in channel d penetrates the interior of piston 3 through ports k located in the piston 3, so that the working pressure acts on one surface 1 which causes piston 3 to remain in its radially inward position because the fluid pressure acting on the surface j of piston 3 is relatively lowered. In this case piston 3 becomes the cylinder for piston 4, piston 4 then moving radially outwardly and actuating the crosshead A.

The distributing unit C includes a plate 15 fixed on stator 1 in any suitable way, such as for example by means of screws (not shown). Channels m and n extend through plate 15 to supply pressure liquid to the pistons 3 and 4, respectively, for the change-over control. A rotor distributor 16 with grooves O is mounted above the plate 15. Distributor 16 is rotatably driven by supplying shaft 17 fixed by means of flange 18 on part 9 of rotor D. Another plate 19 is mounted on distributor 16, and this plate can move in a longitudinal direction in seat b in stator 1. Annular seats p are located in the plate 19, in which seats there are arranged a plurality of stacked disc springs 20 as well as supply pipes 21 and compensation cylinders 22. When there is no pressure in pipes 21 the springs 20 press plate 19, thus clamping the distributor 16 between the plates 15 and 19. When pressure liquid is introduced through one of the pipes 21, it can pass into grooves m and o, respectively, through a groove Q located in the plate 19 and thus arriving at the pistons 3 or 4. Liquid distribution is performed adequately due to the synchronous rotation of distributor 16 with rotor D. Axial pressing forces proportional to the value of the working pressure appear on the plate 19 and consequently on distributor 16 and plate 15 simultaneously with the appearance of working liquid pressure due to compensation cylinder 22.

The above described hydrostatic motor, according to the present invention, has the following advantages:

(a) It can achieve hydrostatic transmissions with high dynamic elasticity;

(b) The change-over control unit has small overall dimensions, and therefore it is easily located on any hydrostatic motor; and (c) Owing to the fact that the distributing unit is designed so that wear which appears during work is automatically compensated, hydrostatic efficiency of the motor is maintained roughly constant, within the range of high efficiencies during the entire working life of the motor.

Although the invention is illustrated and described with reference to one preferred embodiment thereof, it is to be expressly understood that it is in no way limited to the disclosure of such a preferred embodiment, but is capable of numerous modifications within the scope of the appended claims.

What is claimed is:

1. A hydrostatic motor including a rotor, a stator, radially arranged hydraulic cylinders located in the stator, first, tubular pistons housed in the cylinders, second pistons located within said first pistons, said first pistons constituting working cylinders for said second pistons, the first pistons each having a closed end with an outer surface having an area substantially greater than that of the corresponding end of the second piston therein, duct means arranged in the stator for the supply of pressure fluid to the first and second pistons, a drain duct circuit, a crosshead for each set of first and second pistons, the crossheads being displacable by said second pistons when the motor is operating in a first, lower duty operational mode, a change-over unit for placing the motor in either said first, lower duty operational mode or in a second, heavy duty operational mode, said first piston functioning when the motor is operating in said second operational mode, a fluid distribution unit housed in the stator and including a distributor having a rotary part, and means for driving the rotary part of the distributor in synchronism with the rotor, said change-over unit comprising a valve which in the second operational mode delivers fluid via ducting to the outer surface of the first pistons for driving them and which in the first operational mode interrupts pressure fluid flow to the said outer surfaces of the first pistons while simultaneously causing fluid communication between said outer surfaces of the first pistons and the drain circuit and causing pressure fluid flow to the said corresponding ends of the second pistons.

2. A motor as claimed in claim 1, comprising a multi-lobed cam surrounding the rotor, the lobes on the cam being disposed on the radially inner surface of the cam, each first and second piston driving the crosshead with a rectilinear motion, and a cam following roller journaled on each of the crossheads.

3. A motor as claimed in claim 2 comprising antifriction bearings disposed between each crosshead and the radial bore in the stator in which it reciprocates.

4. A hydrostatic motor including a rotor, a stator, radially arranged hydraulic cylinders located in the stator, first, tubular pistons housed in the cylinders, second pistons located within said first pistons, said first pistons constituting working cylinders for said second pistons, the first pistons each having a closed end with an outer surface having an area substantially greater than that of the corresponding end of the second piston therein, duct means arranged in the stator for the supply of pressure fluid to the first and second pistons, a drain duct circuit, a crosshead for each set of first and second pistons, the crossheads being displacable by said second pistons when the motor is operating in a first, lower duty operational mode, a change-over unit for placing the motor in either said first, lower duty operational mode or in a second, heavy duty operational mode, said first piston functioning when the motor is operating in said second operational mode, a fluid distribution unit housed in the stator and including a distributor having a rotary part, and means for driving the rotary part of the distributor in synchronism with the rotor, said change-over unit comprising a valve which in the second operational mode delivers fluid via ducting to the outer surface of the first pistons for driving them and which in the first operational mode interrupts pressure fluid flow to the said outer surfaces of the first pistons while simultaneously causing fluid communication between said outer surfaces of the first pistons and the drain circuit and causing pressure fluid flow to the said corresponding ends of the second pistons, the valve of the change-over unit being hydraulically operated, and comprising a separate source of hydraulic pressure fluid and a control valve therefor for operating the said valve so as selectively to position it in a first position when the motor operates in its first operational mode and in a second position when the motor operates in its second operational mode.

5. A motor as claimed in claim 4 wherein the said control valve of the change-over unit places the motor in its second, higher duty mode of operation when there is an absence of control fluid pressure exerted upon the valve of the change-over unit.

6. A motor as claimed in claim 5, wherein the valve of the change-over unit is placed in its second position by being subjected to control fluid pressure from said separate pressure fluid source, thereby to place the motor in its first, lower duty operational mode.

7. A hydrostatic motor including a rotor, a stator, radially arranted hydraulic cylinders located in the stator, first, tubular pistons housed in the cylinders, second pistons located within said first pistons, said first pistons constituting working cylinders for said second pistons, the first pistons each having a closed end with an outer surface having an area substantially greater than that of the corresponding end of the second piston therein, duct means arranged in the strator for the supply of pressure fluid to the first and second pistons, a drain duct circuit, a crosshead for each set of first and second pistons, the crossheads being displaceable by said second piston when the motor is operating in a first, lower duty operational mode, a change-over unit for placing the motor in either said first, lower duty operational mode or in a second, heavy duty operational mode, said first piston functioning when the motor is operating in said second operational mode, a fluid distribution unit housed in the stator and including a distributor having a rotary part, and means for driving the rotary part of the distributor in synchronism with the rotor, said change-over unit comprising a valve which in the second operational mode delivers fluid via ducting to the outer surface of the first pistons for driving them and which in the first operational mode interrupts pressure fluid flow to the said outer surfaces of the first pistons while simultaneously causing fluid communication between said outer surfaces of the first pistons and the drain circuit and causing pressure fluid flow to the said corresponding ends of the second pistons, the distributor unit including a first plate fixed in the stator in which ducts are located for pressure fluid supply to the pistons and valve, the rotary part of the distributor being a second plate, the second plate being capable of moving in a direction roward and away from the first plate, resilient means for urging the second plate toward the first plate, and compensation cylinders supplied with pressure fluid for thrusting the second plate against the first plate with a force proportional to the pressure of the working fluid, thereby providing automatic compensation for wear of the plates of the distributing unit as well as insuring the sealing of the drain duct circuit against leakage of the pressure fluid which is fed to the pistons.

8. A hydrostatic motor including a rotor, a stator, radially arranged hydraulic cylinders located in the stator, first, tubular pistons housed in the cylinders, second pistons located within said first pistons, said first pistons constituting working cylinders for said second pistons, the first pistons each having a closed end with an outer surface having an area substantially greater than that of the corresponding end of the second piston therein, duct means arranged in the stator for the supply of pressure fluid to the first and second pistons, a drain duct circuit, a crosshead for each set of first and second pistons, the crossheads being displacable by said second pistons when the motor is operating in a first, lower duty operational mode, a change-over unit for placing the motor in either said first, lower duty operational mode or in a second, heavy duty operational mode, said first piston functioning when the motor is operating in said second operational mode, a fluid distribution unit housed in the stator and including a distributor having a rotary part, and means for driving the rotary part of the distributor in synchronism with the rotor, said change-over unit comprising a valve which in the second operational mode delivers fluid via ducting to the outer surface of the first pistons for driving them and which in the first operational mode interrupts pressure fluid flow to the said outer surfaces of the first pistons while simultaneously causing fluid communication between said outer surfaces of the first pistons and the drain circuit and causing pressure fluid flow to the said corresponding ends of the second pistons, a multilobed cam surrounding the rotor, the lobes on the cam being disposed on the radially inner surface of the cam, each first and second piston driving the crosshead with a rectilinear motion, and a cam following roller journaled on each of the crossheads, the crossheads reciprocating in bores in the stator, and comprising a cover over the radially outer end of the bores in the stator in which the crossheads reciprocate, and shock-absorbing resilient buffer means disposed between the crosshead and the cover.

* * * * *